United States Patent [19]

Novay

[11] Patent Number: 4,615,641

[45] Date of Patent: Oct. 7, 1986

[54] BARGE REPAIR DEVICE

[76] Inventor: Paul L. Novay, Rte. 3, Box 235, Wilmer, Ala. 36587

[21] Appl. No.: 637,367

[22] Filed: Aug. 3, 1984

[51] Int. Cl.[4] ..... E02D 23/02; B63C 11/00

[52] U.S. Cl. ..... 405/12; 405/11; 405/194

[58] Field of Search ..... 405/12, 11, 13, 186, 405/194, 188, 192; 114/227, 45, 322

[56] References Cited

U.S. PATENT DOCUMENTS

| | | | |
|---|---|---|---|
| 689,979 | 12/1901 | Mason | 405/12 |
| 783,276 | 2/1905 | Hughes | 405/12 |
| 932,719 | 8/1909 | Reinhardt | 405/12 |
| 2,105,014 | 1/1938 | Segel . | |
| 2,166,865 | 7/1939 | Gerdes | 405/12 |
| 2,360,690 | 10/1944 | Koulichkov | 405/12 |
| 2,636,354 | 4/1953 | Glassgold | 405/12 |
| 3,638,437 | 2/1972 | Fukuda | 405/12 |
| 3,768,265 | 10/1973 | Brouillette | 405/12 |
| 3,849,996 | 11/1974 | Mittleman | 405/12 |
| 4,292,914 | 10/1981 | Jonsson | 405/12 X |

FOREIGN PATENT DOCUMENTS

| | | | |
|---|---|---|---|
| 1485501 | 9/1977 | United Kingdom | 405/12 |
| 921958 | 4/1982 | U.S.S.R. | 405/12 |

*Primary Examiner*—Dennis L. Taylor

*Attorney, Agent, or Firm*—Armstrong, Nikaido, Marmelstein & Kubovcik

[57] ABSTRACT

A portable, floatable barge repair device is disclosed having a water tight box having front, back and side walls and a bottom, and a top opening. A superstructure extends generally upwardly from the back wall of the box, the superstructure having an upper back wall generally adjacent to the back wall of the box, the superstructure also having an upper open top and a side opening opposite the upper back wall. The periphery of the top opening and the side opening form a seal surface for engaging a portion of a barge to be repaired, and gasket means are disposed on the seal surface for providing a water tight seal between the barge and the box. Ballast means are disposed on the front wall of the box opposite the back wall, and ballast tanks surround the box for receiving water therein. Means for securing the repair device to a barge are also provided.

7 Claims, 4 Drawing Figures

BARGE REPAIR DEVICE

BACKGROUND OF THE INVENTION

The instant invention relates generally to floatable vessel repair devices, and more particularly to repair devices for repairing barges.

In situations when a barge or similar type vessel needs repairs performed below the water line, it must be taken to a dry dock and have the repairs performed there. However, this is a very expensive and time consuming operation.

Alternatives are available to moving a barge into dry dock. Some of the alternatives include ship repair equipment which is composed of a flexible sheet which can cover the hull for working below the water line. In fact, different types of devices for repairing holes have been used. Such devices have been flexible in order to conform to the shape of the hull and other devices have been made in specific shapes. In these cases, however, such devices are usually very large and complex. Thus, they are inherently expensive, difficult and time consuming to use.

SUMMARY OF THE INVENTION

The instant invention is directed to a floatable vessel repair device, and particularly a floatable barge repair device. The device of the instant invention provides a simple and inexpensive device for reaching portions of a barge below the water line for performing repairs thereon. The barge repair device of the instant invention is designed to be partially submerged and then attached to the edge of a floating barge to repair leaks along the seams of the barge. Water is first pumped into a portion of the barge repair device to cause it to become partially submerged. The repair device can then be moved into position next to the barge and may be secured thereto by cables or some other securing means. Water is then pumped out of the barge repair device which has a water tight seal between itself and the barge. Workmen are then able to go into the repair device to work on the barge and make repairs. Thus, the necessity of taking the barge into dry dock has been averted. The expense, as well as the length of time to repair a barge in dry dock is thus eliminated through the use of the instant invention.

The invention as set forth in this application is directed to a floatable barge repair device comprising a water tight box having an open top and a back wall, a super structure extending generally upward from the back wall of the box, the super structure having an upper back wall adjacent the back wall of said box, the super structure having an open top and a side opening opposite the upper back wall, the periphery of the top opening and the side opening forming a sealing surface for engaging a portion of the barge to be repaired, and a gasket means disposed on the sealing surface for providing a water tight seal between the barge and the box. Further, a ballast means is disposed on the box opposite the back wall. Additionally, a means for securing the repair device to a barge is also provided.

BRIEF DESCRIPTION OF THE DRAWINGS

The above described invention will be more specifically described and will be better understood with reference to the below described drawings, in which.

DETAILED DESCRIPTION OF THE PREFERRED EMBODIMENT

The preferred embodiment of the instant invention will now be described with reference to FIGS. 1–4.

Figure 1:
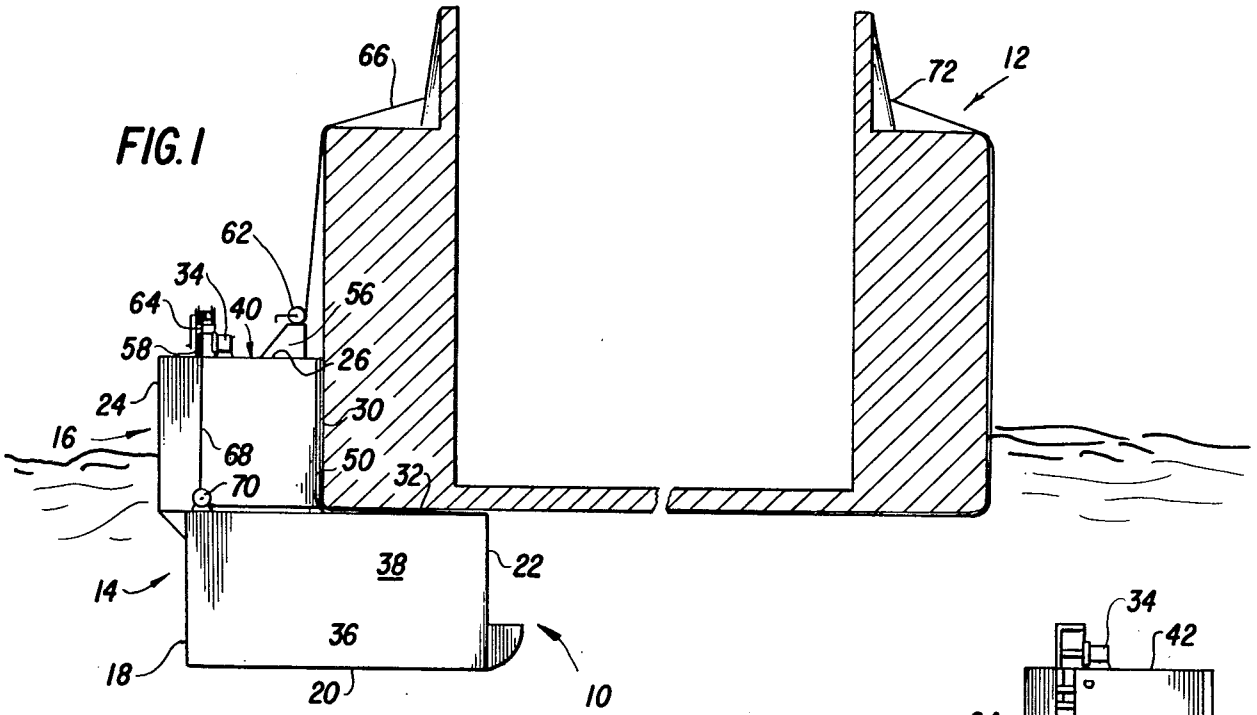
FIG. 1 is a sectional drawing of the repair device of the instant invention secured to a barge.
Figure 3:
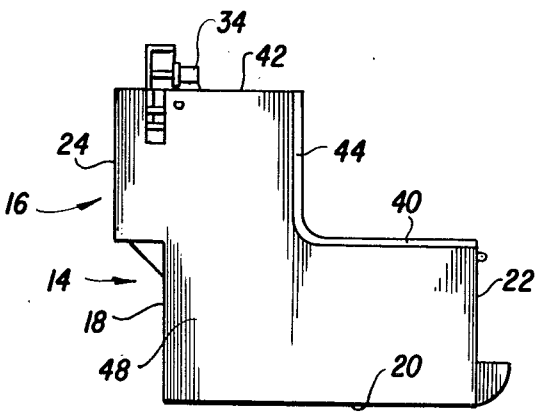
FIG. 3 is a side view of the repair device of the instant invention.

In FIG. 1, barge repair box 10 is attached to barge 12 in a working position. Barge repair box 10 has a box section 14 and a superstructure section 16. Box section 14 has a back wall 18, a bottom 20, and a front wall 22. Superstructure 16 has an upper back wall 24 and an upper open top 26. The upper back wall 24 may be disposed the rear of the back wall 18 to provide sufficient room for the ballast and pump controls described below.

Barge repair box 10 attaches to the side 30 and bottom 32 of the barge. The barge repair box 10 is ideally made of steel or aluminum, but may be constructed of any suitable material. A pump 34 is disposed on superstructure section 16. Pump 34 is connected to pipes 36 which are used for filling and draining the interior 38 of the barge repair box.

Figure 2:
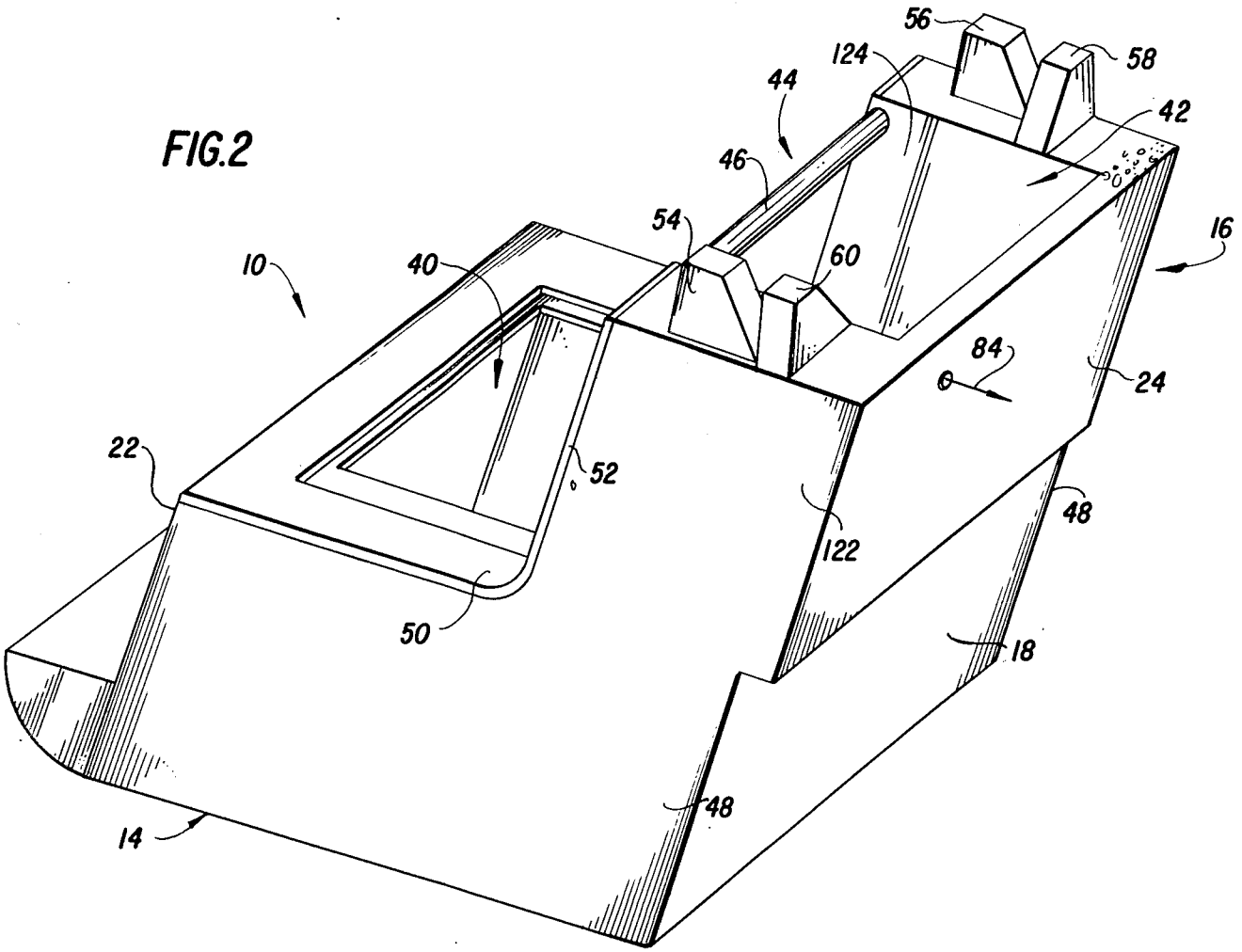
FIG. 2 is a perspective view of the repair device of FIG. 1.

As can be seen from FIG. 2, back wall 18 of the box section and upper back wall 24 generally form a single wall. The superstructure section 16 and the box section 14 are intergral with each other, thus forming the barge repair box 10. Box section 14 has a top opening 40 and superstructure section 16 has an open upper top 26 and a front opening 44 opposite the upper back wall 24. Side walls 48 connect the front wall 22 to the back wall 18 and upper back wall 24. Bracing member 46 provides bracing between the two side walls 48. Bracing member 46 is on the front of the super structure opposite the upper back wall 24.

A gasket means 15 is disposed along the periphery of top opening 40 of the box section 14 and along the vertical peripheral surfaces 52 of the front opening 44 of superstructure section 16. The gasket means may be made of neoprene or other suitable material. Pedestals 54, 56, 58 and 60 are provided for mounting a winch on each pedestal. A winch 62 is shown on pedestal 56 in FIG. 1. Also, winch 64 is disclosed on top of pedestal 58. Winch 64 is used to draw in cable 66 which is attached at a mounting point on the near side of the barge. Winch 64 winds cable 68 which winds around pulley 70 and extends underneath the barge and is mounted at a point 72 on the far side of the barge. The cables, when the proper tension is applied by the winches (it should also be noted that winches are also provided on pedestals 54 and 60 and operate in the same manner), provide a stable positioning means for holding the barge repair box up next to the barge itself.

Figure 4:
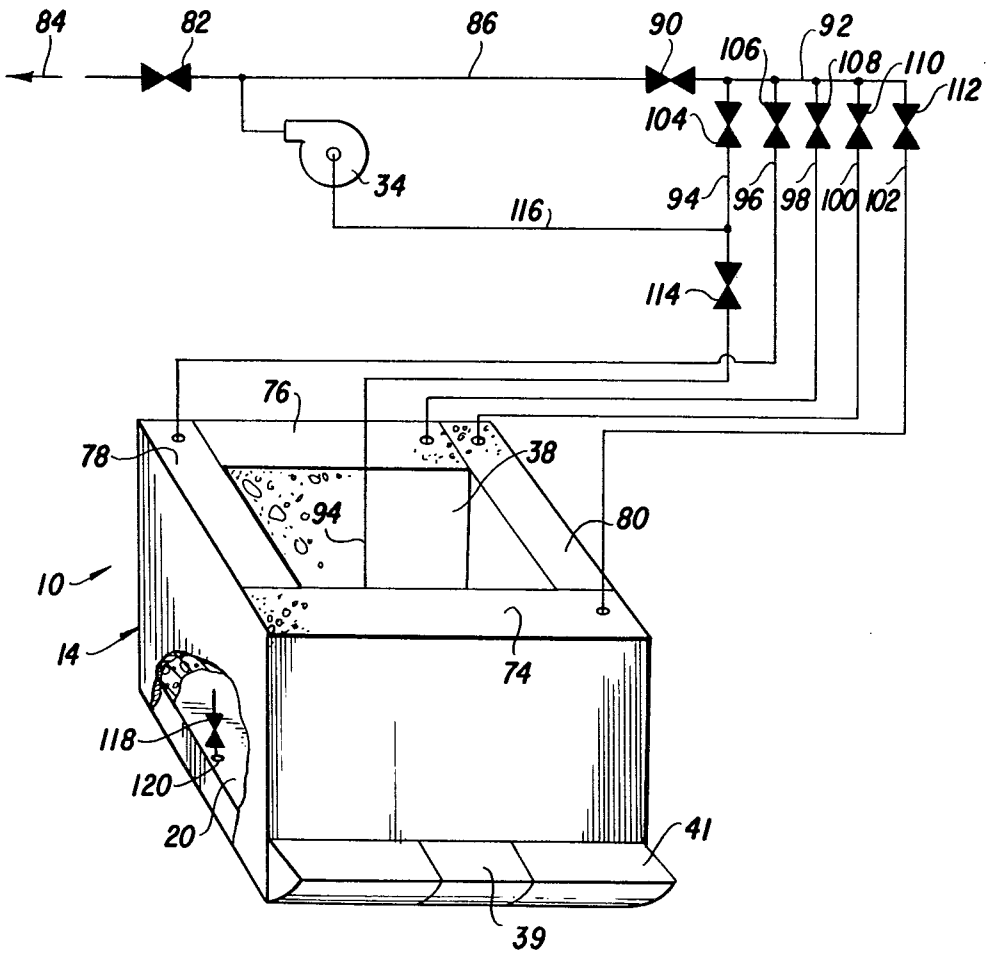
FIG. 4 is a schematic diagram of the pump and ballast system of the repair device of the instant invention.

FIG. 4 is a schematic diagram of the pumping and ballast system of the instant invention. The barge repair box 10 is shown here as only the lower box section 14 for illustrative purposes. A front ballast tank 74 is shown on the very front of the box section. Back ballast tank 76 is in the rear portion and starboard tank 78 is on the right side and port tank 80 is on the left. These tanks form a box section around the interior 38. Pump 34 is indicated in the diagram of FIG. 4, and can be seen also in FIGS. 1 and 3. Port air tank 122 and starboard air tank 124 (see FIG. 2) are provided above port ballast tank 80 and starboard ballast tank 78, respectively. Air tanks 122 and 124 keep the barge repair box from sinking when the ballast tanks are filled with water. The strategic position of air tanks 122 and 124 allow the barge box to remain stable in the water, even when the ballast tanks are filled with water. Air tanks 122 and 124 are always used for buoyancy.

A variety of valves and lines are provided for connecting the pump 34 to any one of the ballast tanks or to the interior 38 of the box. A first valve 82 is provided between pump 34 and the outside of the box indicated by arrow 84. A line 86 proceeds from the exit end of pump 34 to second valve 90 and manifold 92. Manifold 92 splits into lines 94, 96, 98, 100 and 102, each line having a corresponding valve 104, 106, 108, 110 and 112, respectively. Line 94 connects with line 116 which connects to the intake portion of pump 34. Line 94 also connects with valve 114 and from valve 114 to the interior 38 of the box section 14. A valve 118 is shown connected to the bottom 20 of the box section 14. Valve 118 is connected to an opening 120 in the bottom of the interior which connects to the sea water. When valve 118 is open, the sea water flows into the interior 38. A filter (not shown) is provided on the bottom of valve 118 to keep debris from coming into the interior 38. Line 94 extends to the bottom of the interior 38, such that it may draw water out of the interior 38. Line 96 extends to starboard ballast tank 78 and extends to the bottom thereof to be able to draw water out of the tank. Line 98 extends to back ballast tank 76 and to the bottom thereof for drawing water therefrom. Line 100 extends to port tank 80 and to the bottom thereof for drawing water out of it. Line 102 extends to front ballast tank 74 and extends to the bottom thereof to draw water therefrom. Appropriate venting is provided on each tank. Because of the valve arrangement, water can be pumped from the interior 38 into any one of the four ballast tanks. The starboard ballast tank 78 and port ballast tank 80 also extend upward into the superstructure portion 16 (not shown in FIG. 4 to provide greater clarity). For example, water may be pumped from the interior 38 into front ballast tank 74 by opening valve 114 and closing valve 104, closing valve 82, opening valve 90, closing valves 106, 108 and 110, and opening valve 112.

The size of the barge repair box 10 is small enough so that it may portable. Barge repair box 10 may be fit onto a trailer, similar to a trailer used to carry a motor boat, and may be trailered easily and safely from one repair site to another.

In operation, the barge repair box may be trailered down to the repair site. It can then be launched into the water, much the same as a boat. The barge repair box 10 is floatable and is stable floating due to ballast 39 disposed in the front rake 41. For example, about 250 pounds of ballast is used in the described embodiment. This figure could vary with different embodiments. The rake 41 serves as a bow to allow the barge repair box to be pushed around in the water without being upset.

When near the barge, the first step in positioning the barge repair box in its actual position is to open valve 18 to flood the interior 38. As the interior 38 is filling up, the ballast tanks may be filled in which ever order is most appropriate. For example, if the rear ballast tank 76 is to be filled first, then valve 114 is to be opened and valve 82 closed. Valve 90 is to be opened and valve 104, 106, 110 and 112 are to be closed. Valve 108 is to be opened. Thus, pump 34 is connected to pump water from the interior 38 through valve 114 through pump 34 through valve 90, through valve 108 and into back ballast tank 76. The other ballast tanks may be filled in the same manner. It is important that the ballast tanks be filled in the correct manner in order to maintain the attitude and stability of the barge repair box. Cables 66, 68 and the corresponding cables on the other side of the barge repair box are then strung out to their proper mounting positions on the barge. For example, cable 66 is attached to a point on the near side of the barge, while cable 68 is threaded underneath the barge and attached to a point on the far side of the barge thereof. The barge repair box is then pushed into position such that the gasket means 50 engages the barge as shown in FIG. 1. Winches 62 and 64 and the corresponding winches on the other side of the barge repair box can then be tightened to position the barge repair box snugly against the barge.

Next, the interior 38 is pumped free of water by opening valve 114 and valve 82. Valves 90, 104, 106, 108, 110 and 112 remain closed. When the interior 38 is pumped free of water, the ballast tanks may be pumped out if necessary to provide a generally neutral buoyancy for the barge repair box so that the attitude of the barge itself is not upset. In general, the ballast tanks will retain a certain amount of water for ballast.

With the interior 38 pumped out, the underside of the barge within the barge repair box 10 is now ready for any repairs to be performed thereon. Workers may descend through the top opening 40 into the interior 38 and may work on the side and bottom of the barge. When finished, and all tools and equipment are removed, the barge repair box may then be filled with water and floated away.

In doing this, the interior 38 is first filled through valve 118. Once filled, the winches may be loosened in order to loosen the cables positioning the barge repair box 10 next to the barge. When the barge repair box is separated from the barge, and pulled away from it, it may be refloated by pumping water from the ballast tanks. Of course, this must be done in an orderly manner in order to maintain the attitude and stability of the barge repair box. Once the barge repair box has risen sufficiently, the interior 38 may also be pumped out.

When all the ballast tanks in the interior are pumped out, the barge repair box may be loaded up on a trailer and moved to the next repair site.

It should be understood that the specific form of the invention hereinabove described is intended to be representative only, as certain modifications within the scope of these teachings will be apparent to those skilled in the art.

Accordingly, reference should be made to the following claims in determining the full scope of the invention.

I claim:

1. A rigid, portable, floatable barge repair device comprising:

a water tight box having front, back and side walls and a bottom, and a top opening;

a superstructure extending generally upwardly from the back wall of said box, said superstructure having an upper back wall generally adjacent to said back wall of said box and opposing side walls adjacent said upper back wall, said superstructure having an upper open top opening directly to the atmosphere during operation and a side opening opposite said upper back wall;

a seal surface formed by the periphery of said top opening and said side opening for engaging a portion of a barge to be repaired;

gasket means disposed on said seal surface for providing a water tight seal between the barge and the repair device;

ballast means disposed on said front wall of said box opposite said back wall;

ballast tanks surrounding said box for receiving water therein; and means for securing the repair device to a barge to be repaired.

2. The barge repair device of claim 1, further including means for pumping water into or out of said repair device.

3. The barge repair device of claim 2, wherein said ballast tanks include a front, rear, starboard and port tanks, and said pumping means includes a pump and a plurality of valves and lines which pump water from the center of the box between said walls into any one of said ballast tanks and pump water from any one of said ballast tanks completely out of the box.

4. The barge repair device of claim 1, wherein said securing means includes a line attached to the barge repair device and wrapped underneath the barge and secured to the far side barge to be repaired and another line attached to said barge repair device and secured to the near side of the barge such that said repair device securely contacts said barge.

5. The barge repair device of claim 1, wherein a bracing member is disposed between two side walls of said superstructure which are adjacent said upper back wall, and said bracing member being spaced apart from said upper back wall.

6. The barge repair device of claim 3, wherein air tanks are provided in said superstructure for providing buoyancy to the barge repair device.

7. The barge repair device of claim 6, wherein one each of said air tanks is disposed above each of said starboard and port ballast tanks.

* * * * *